US011776708B2

(12) United States Patent
Li et al.

(10) Patent No.: US 11,776,708 B2
(45) Date of Patent: Oct. 3, 2023

(54) LIQUID METAL CONDUCTIVE PASTE AND ELECTRONIC DEVICE

(71) Applicant: Beijing Dream Ink Technologies Co., Ltd., Beijing (CN)

(72) Inventors: Ping Li, Beijing (CN); Shijin Dong, Beijing (CN); Zhenlong Men, Beijing (CN)

(73) Assignee: Beijing Dream Ink Technologies Co., Ltd., Beijing (CN)

( * ) Notice: Subject to any disclaimer, the term of this patent is extended or adjusted under 35 U.S.C. 154(b) by 0 days.

(21) Appl. No.: 17/622,695

(22) PCT Filed: Dec. 16, 2020

(86) PCT No.: PCT/CN2020/136874
§ 371 (c)(1),
(2) Date: Dec. 23, 2021

(87) PCT Pub. No.: WO2021/121278
PCT Pub. Date: Jun. 24, 2021

(65) Prior Publication Data

US 2022/0262538 A1 Aug. 18, 2022

(30) Foreign Application Priority Data

Dec. 19, 2019 (CN) ..... 201911313432.7

(51) Int. Cl.
*H01B 1/22* (2006.01)

(52) U.S. Cl.
CPC ..... *H01B 1/22* (2013.01)

(58) Field of Classification Search
CPC ... H01B 1/00; H01B 1/20; H01B 1/22; C09D 5/24
See application file for complete search history.

(56) References Cited

U.S. PATENT DOCUMENTS 5,238,087 A * 8/1993 Garrido ..... B66B 17/12 187/253
7,306,823 B2 * 12/2007 Sager ..... B22F 1/056 977/773

(Continued)

FOREIGN PATENT DOCUMENTS

CN 102272863 A 12/2011
CN 104700924 A 6/2015

(Continued)

OTHER PUBLICATIONS

Liu et al "Oxide rupture-induced conductivity in liquid metal nanoparticles by laser and thermal sintering", Nanoscale, 2019, 11, 17615.*

(Continued)

*Primary Examiner* — Mark Kopec
(74) *Attorney, Agent, or Firm* — Weaver Austin Villeneuve & Sampson LLP

(57) ABSTRACT

The present disclosure provides a liquid metal conductive paste and an electronic device, and relates to a technical field of new materials. The liquid metal conductive paste provided by the present disclosure includes: 1%-50% by weight of a liquid metal microcapsule, 30%-80% by weight of a conductive powder, 1%-25% by weight of a base polymer and 10%-40% by weight of a solvent. A capsule wall of the liquid metal microcapsule is made of a coating polymer, and a capsule core is made of a liquid metal. Melting point of the liquid metal satisfies: the liquid metal is in a liquid state at least when the wire made of the liquid metal conductive paste is deformed. The present disclosure can achieve a better flexible wire.

20 Claims, 3 Drawing Sheets

(56) References Cited

U.S. PATENT DOCUMENTS

| | | | | |
|---|---|---|---|---|
| 10,937,716 | B2 * | 3/2021 | Rykaczewski | H01L 23/3737 |
| 2005/0228097 | A1 * | 10/2005 | Zhong | B82Y 30/00 524/439 |
| 2014/0264191 | A1 | 9/2014 | Rantala | |
| 2017/0062374 | A1 * | 3/2017 | Chu | H01L 23/5328 |
| 2018/0305563 | A1 * | 10/2018 | Oh | C09D 133/02 |
| 2018/0354037 | A1 * | 12/2018 | Thuo | B22F 10/20 |
| 2022/0367524 | A1 * | 11/2022 | Park | H01B 5/14 |

FOREIGN PATENT DOCUMENTS

| | | | |
|---|---|---|---|
| CN | 105609163 | A | 5/2016 |
| CN | 106486183 | A | 3/2017 |
| CN | 108986949 | A | 12/2018 |
| CN | 109065213 | A | 12/2018 |
| CN | 109570515 | A | 4/2019 |
| CN | 109627829 | A | 4/2019 |
| CN | 110729071 | A | 1/2020 |
| JP | 2016056300 | A | 4/2016 |
| KR | 102013796 | B1 | 10/2019 |
| WO | WO 2021/121278 | A1 | 6/2021 |

OTHER PUBLICATIONS

Chinese First Office Action dated Feb. 19, 2020 issued in CN Application No. 201911313432.7.

International Search Report dated Mar. 16, 2021 issued in PCT/CN2020/136874.

Chinese Notice of Allowance dated Mar. 23, 2020 issued in CN Application No. 2019113132432.7.

China Science Daily. "Non-official translation: Self-Healing Metals," https://www.cnmn.eom.cn/ShowNewsl.aspx?id_279048&page_2, Oct. 25, 2013 (Oct. 25, 2013), p. 1 paragraph 4, p. 2 paragraphs 1-2.

* cited by examiner

LIQUID METAL CONDUCTIVE PASTE AND ELECTRONIC DEVICE

CROSS-REFERENCE TO RELATED APPLICATION

The present application claims priority to Chinese Patent Application No. 201911313432.7, titled with "liquid metal conductive paste and electronic device" and filed on Dec. 19, 2019, the content of which is incorporated herein by reference in its entirety.

TECHNICAL FIELD

The present disclosure relates to the field of new materials, and, particularly, relates to a liquid metal conductive paste and an electronic device.

BACKGROUND

In recent years, with rapid development of electronic information technology, the market has become increasingly demanding on the specificity and functionality of liquid metal conductive pastes. In order to meet the above requirements, the liquid metal conductive paste has gradually developed from a single material, such as metal or carbon, to a composite liquid metal conductive paste. The composite liquid metal conductive paste is mostly made of solid conductive media together with carrier materials. For example, the composite liquid metal conductive paste can be composited by combining conductive particles such as silver powder, copper powder, carbon powder, graphene, etc. with an epoxy resin, an acrylic resin, a polyurethane resin, a vinyl chloride-vinyl acetate copolymer resin, and a silicone resin.

The applicant found that such a composite liquid metal conductive paste is generally difficult to have good bending resistance and tensile resistance, such that it cannot meet requirements for high flexibility (such as, bending resistance, tensile resistance, distortion resistance) of flexible electronic products after the liquid metal conductive paste is molded.

SUMMARY

The present disclosure provides a liquid metal conductive paste and an electronic device, which can cause a flexible wire to have better flexibility.

In a first aspect of the present disclosure, a liquid metal conductive paste is provided, which adopts following technical solutions.

A liquid metal conductive paste, includes: a liquid metal microcapsule; a base polymer; a conductive powder; and a solvent, in which the liquid metal microcapsule has a capsule wall of a coating polymer, and a capsule core of a liquid metal; and melting point of the liquid metal satisfies a condition that the liquid metal is in a liquid state at least when the wire made of the liquid metal conductive paste is deformed.

Optionally, the liquid metal conductive paste includes: 1%-50% by weight of a liquid metal microcapsule, 30%-80% by weight of a conductive powder, 1%-25% by weight of a base polymer and 10%-40% by weight of a solvent.

Optionally, the liquid metal conductive paste is formed by compounding a first component and a second component; the first component includes the liquid metal microcapsule; the second component includes the base polymer and the conductive powder; the first component further includes a first solvent, and/or, the second component further includes a second solvent.

Optionally, the first component further includes a silicone additive for defoaming and increasing flexibility.

Optionally, a weight ratio of the silicone additive to the coating polymer is in a range from 1:5 to 1:10.

Optionally, a weight ratio of the first component to the second component in the liquid metal conductive paste is in a range from 10:1 to 1:9.

Optionally, the first component includes 30% to 99% by weight of the liquid metal, 0.1% to 30% by weight of the coating polymer, and 0.9% to 50% by weight of the first solvent.

Optionally, the weight content of the base polymer in the second component is in a range from 10% to 40%, and the weight content of the conductive powder in the second component is in a range from 20% to 90%.

Optionally, the liquid metal microcapsule has a diameter ranging from 3 μm to 10 μm.

Optionally, the liquid metal includes at least one of gallium, gallium indium alloy, gallium tin alloy, gallium indium tin alloy, or gallium indium tin zinc alloy.

Optionally, the coating polymer includes at least one of polyester resin, melamine resin, chlorine vinegar resin, vinyl chloride-vinyl acetate resin, silicone resin, gelatin, sodium alginate, polyvinylpyrrolidone, chitosan, polyurethane resin, polyacrylic resin, vinyl chloride-vinyl acetate resin, epoxy resin, fluorocarbon resin, epoxy acrylic resin, epoxy acrylate resin, polyester acrylate resin, phenolic resin, nitrocellulose, ethyl cellulose, alkyd resin, amino resin, vinyl chloride-vinyl acetate copolymer resin, hydroxyl-modified vinyl chloride-vinyl acetate copolymer resin, thermoplastic polyurethane resin, or isocyanate and its oligomer having a blocking group.

Optionally, the base polymer includes at least one of polyester resin, polyurethane resin, polyacrylic resin, vinyl chloride-vinyl acetate resin, epoxy resin, epoxy acrylic resin, epoxy acrylate resin, polyester acrylate resin, phenolic resin, nitrocellulose, ethyl cellulose, alkyd resin, amino resin, polyurethane resin with a reactive group, saturated polyester resin with a reactive group, or a flexible chlorine vinegar resin with a reactive group.

In a second aspect of the present disclosure, a liquid metal conductive paste is provided, which adopts following technical solutions.

The liquid metal conductive paste, includes:

- a liquid metal microcapsule, the liquid metal microcapsule has a capsule wall of a coating polymer, and a capsule core of a liquid metal;
- a basic polymer;
- a conductive powder;
- a solvent;
- a crosslinking agent;
- in which, melting point of the liquid metal satisfies: the liquid metal is in a liquid state at least when the wire made of the liquid metal conductive paste is deformed; and the crosslinking agent is configured to have a crosslinking reaction with the coating polymer and/or with the base polymer to form a three dimensional network structure during a curing process of a wire made of the liquid metal conductive paste.

Optionally, the liquid metal conductive paste, includes: 1% to 50% by weight of a liquid metal microcapsule; 30% to 80% by weight of a conductive powder; 1% to 25% by weight of a base polymer; 10% to 40% by weight of a solvent; and 1% to 15% by weight of a crosslinking agent.

Optionally, the liquid metal conductive paste is formed by compounding a first component and a second component; the first component includes the liquid metal microcapsule; the second component includes the base polymer and the conductive powder; the first component further includes a first solvent, and/or, the second component further includes a second solvent; and the crosslinking agent is premixed in the first component, and/or, the crosslinking agent is premixed in the second component.

Further, the base polymer and/or the coating polymer contain a reactive group, the reactive group being a hydroxyl, an amino, or carboxyl.

Further, the reactive group is a hydroxyl or an amino; and the crosslinking agent is isocyanate and an oligomer thereof.

Preferably, the crosslinking agent is isocyanate and its oligomer having a blocking group.

Optionally, the coating polymer includes at least one of vinyl chloride-vinyl acetate copolymer resin, hydroxyl-modified vinyl chloride-vinyl acetate copolymer resin, thermoplastic polyurethane resin, or isocyanate and its oligomer having a blocking group.

Optionally, the coating polymer has an average molecular weight ranging from 20,000 to 40,000.

Optionally, the conductive powder includes at least one of conductive silver powder, conductive copper powder, or silver copper powder, and the conductive powder has a flake structure, a length-to-thickness ratio ranging from 2 to 5, and a particle size of 1 μm to 5 μm.

In a third aspect of the present disclosure, an electronic device is provided, which adopts following technical solutions.

The electronic device includes a wire, in which the wire is made of a liquid metal conductive paste according to any one of the above items.

The present disclosure provides a liquid metal conductive paste and an electronic device. The liquid metal conductive paste includes: a liquid metal microcapsule having a capsule wall of a coating polymer, and a capsule core of a liquid metal; a base polymer; a conductive powder; and a solvent. The melting point of the above liquid metal satisfies: the liquid metal is in a liquid state at least when the wire made of liquid metal conductive paste is deformed. Therefore, when the wire has deformation such as bending, stretching or twisting, the liquid metal microcapsule will be deformed and ruptured, so that the liquid metal coated therein is released. The above liquid metal is in a liquid state, and thus has better fluidity and deformability, so that the liquid metal can fill and repair the conductive path, thereby achieving a more flexible wire.

BRIEF DESCRIPTION OF DRAWINGS

In order to more clearly explain some embodiments of the present disclosure or the technical solution in the related art, the drawings used in the description of the embodiments or the related art will be briefly described below. The drawings in the following description are some embodiments of the present disclosure. Those skilled in the art may obtain other drawings based on these drawings.

DESCRIPTION OF EMBODIMENTS

Figure 1:
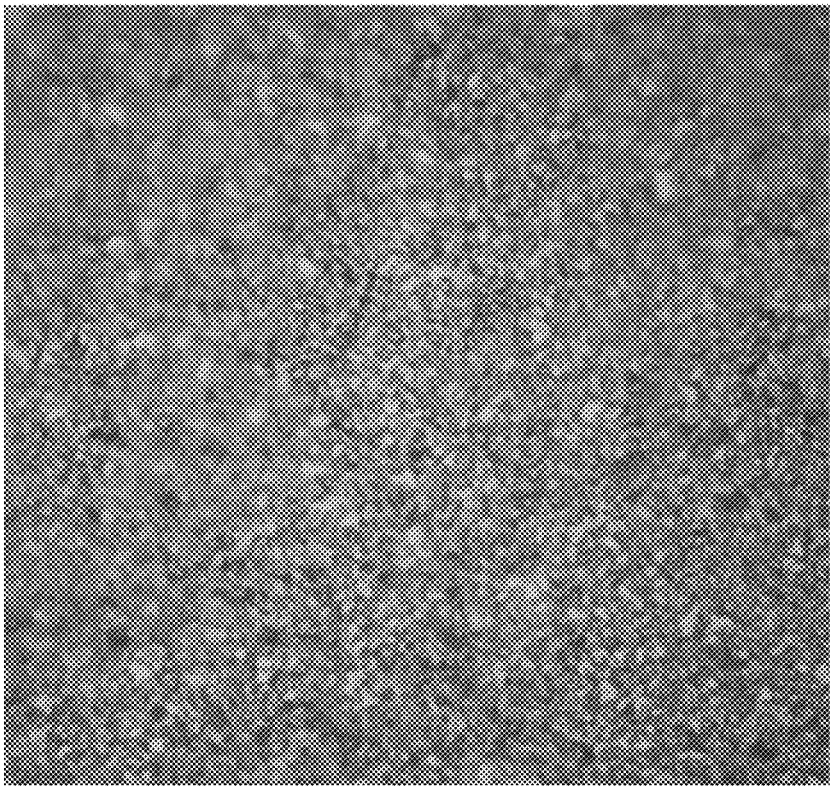
FIG. 1 is an optical micrograph of a first liquid metal conductive paste according to an embodiment of the present disclosure.

In order to more clearly illustrate objects, technical solutions and advantages of embodiments of the present disclosure, the technical solutions in some embodiments of the present disclosure are clearly and completely described below with reference to the accompanying drawings in some embodiments of the present disclosure. The described embodiments are merely part of the embodiments of the present disclosure rather than all of the embodiments. All other embodiments obtained by those skilled in the art shall fall into the scope of the present disclosure.

It should be noted that various technical features in embodiments of the present disclosure can be combined with one another if there is no conflict.

It should be noted that the terms "and/or" or "/" used in the present disclosure is only an association relationship describing associated objects, which means that there can be three relationships, for example, A and/or B can refer to three following situations: only A, A and B, and only B.

Embodiment 1

A first aspect of the present disclosure provides a liquid metal conductive paste. In an embodiment, the liquid metal conductive paste includes: a liquid metal microcapsule having a capsule wall of a coating polymer, and a capsule core of a liquid metal; a base polymer; a conductive powder; and a solvent; melting point of the liquid metal satisfies the condition that the liquid metal is in a liquid state at least when the wire made of the liquid metal conductive paste is deformed.

It should be noted that the above expression "melting point of liquid metal satisfies: the liquid metal is in a liquid state at least when the wire made of the liquid metal conductive paste is deformed" includes following situations. Firstly, if normal operating (that is, there is no obvious deformation) temperature T1 of the wire is the same with the temperature T2 when the wire is deformed, the melting point of the liquid metal should be lower than the temperature T1 or T2, such that the liquid metal is in a liquid state when the wire is deformed. Secondly, if the normal operating temperature T1 of the wire is higher than the temperature T2 when it is deformed, the melting point of the liquid metal should be lower than the temperature T2, such that when the wire is deformed, the liquid metal is in a liquid state. Thirdly, if the normal operating temperature T1 of the wire is lower than the temperature T2 when it is deformed, the melting point of the liquid metal should be lower than the temperature T2, such that when the wire is deformed, the liquid metal is in a liquid state. In this situation, when the wire is operated normally, the liquid metal can be in liquid or solid states. For example, the wire is the antenna with the water washing mark, and the normal operating temperature of the wire is room temperature. The wire is required to be deformed when it is washed by an industrial washer or washed by a continuous batch washer. If the temperature during washing is higher than room temperature, the melting point of the liquid metal shall only satisfy: the liquid metal is in a liquid state during washing, i.e., the melting point of the liquid metal may be lower than the temperature during washing and higher than room temperature, or may be lower than room temperature.

The melting point of the above liquid metal satisfies: the liquid metal is in a liquid state at least when the wire made of liquid metal conductive paste is deformed. Therefore, when the wire has deformation such as bending, stretching or twisting, the liquid metal microcapsule will be deformed and ruptured, such that the liquid metal coated therein is released. The above liquid metal is in a liquid state, and thus has better fluidity and deformability, such that the liquid metal can fill and repair the conductive path, thereby achieving a more flexible wire. The conductivity of the liquid metal conductive paste in the embodiments of the present disclosure can reach $1\times10^6$ S/m or more, and the highest can reach $1\times10^7$ S/m.

The liquid metal conductive paste in the embodiments of the present disclosure may be suitable for molding processes such as screen printing, flexographic printing, transfer printing, extrusion dispensing, metal stencil printing, etc., and can be cured by heating after molding. The liquid metal in the liquid metal conductive paste in the embodiments of the present disclosure is uniformly dispersed to submicrometer-sized or even nano-sized droplets or particles before printing. There is no phase separation or metal overflow during the printing process. However, when it is deformed by bending, stretching or twisting, the liquid metal microcapsule will be deformed and ruptured, such that the coated liquid metal is released, thereby filling and repairing the conductive path.

The liquid metal conductive paste in the embodiments of the present disclosure can be printed on various non-metallic substrates such as PET, PVC, PI, PMMA, PC, ABS, PE, PP, PU, and the like, which can meet the requirements for functionality of the liquid metal conductive paste in different fields of modern industry.

In some embodiments of the present disclosure, the liquid metal conductive paste includes 1%-50% by weight of a liquid metal microcapsule, 30%-80% by weight of a conductive powder, 1%-25% by weight of a base polymer, and 10%-40% by weight of a solvent.

If the weight content of the liquid metal microcapsule in the liquid metal conductive paste is less than 1%, the number of liquid metal microcapsule per unit volume in the finished wire is excessively little. When the wire is bent, stretched or twisted, there is an insufficient amount of liquid metal to fill a gap and resistance variation is obvious. On the contrary, if the weight content of the liquid metal microcapsule in the liquid metal conductive paste is higher than 50%, the finished wire may have a large initial resistance, such that the conductivity is poor, and the liquid metal microcapsule is easily destroyed, which is easy to cause short-circuit. For example, the weight content of the liquid metal microcapsule in the liquid metal conductive paste is 1%, 2%, 5%, 10%, 15%, 20%, 25%, 30%, 35%, 40%, 45% or 50%.

If the weight content of the conductive powder in the liquid metal conductive paste is lower than 30%, the initial resistance of the finished wire is relatively large. If the weight content of the conductive powder in the liquid metal conductive paste is higher than 80%, the amount of liquid metal microcapsules is small, and the flexibility of the finished wire is deteriorated. For example, the weight content of the conductive powder in the liquid metal conductive paste is 30%, 35%, 40%, 45%, 50%, 55%, 60%, 65%, 70%, 75% or 80%.

If the weight content of the base polymer in the liquid metal conductive paste is lower than 1%, it is not conducive to improving the film-forming effect of the liquid metal conductive paste. If the weight content of the base polymer in the liquid metal conductive paste is higher than 25%, the resistance of the liquid metal conductive paste is relatively large. For example, the weight content of the base polymer in the liquid metal conductive paste is 1%, 2%, 5%, 8%, 10%, 15%, 20% or 25%.

In addition, If the weight content of the solvent in the liquid metal conductive paste is lower than 10% or higher than 40%, the liquid metal conductive paste cannot balance the better coating effect of the liquid metal microcapsule and the better fluidity of the liquid metal conductive paste. For example, the weight content of the solvent in the liquid metal conductive paste is 10%, 15%, 20%, 25%, 30%, 35% or 40%.

In some embodiments of the present disclosure, the liquid metal microcapsules has a diameter ranging from 3 μm to 10 μm. When the diameter of the liquid metal microcapsule is smaller than 3 μm, under a bending collapsing force, if a bending radius exceeds 1 mm, the liquid metal microcapsule cannot be broken, such that a large number of gaps formed between the conductive powders formed by external force deformation cannot be filled, and the increase in resistance caused by the effective contact reduction of the conductive powder cannot be compensated. When the diameter of the liquid metal microcapsules is greater than 10 μm, the liquid metal microcapsule has a larger specific gravity, such that the phase separation is more serious, the liquid metal microcapsules may be mainly deposited on the bottom of the printing coating, and the surface distribution is excessively little. In addition, when the amount of the liquid metal microcapsule with excessively large diameter is further increased, a certain amount of liquid metal microcapsules may be broken in advance during the screen printing process, which may not only reduce the overall adhesion of the liquid metal conductive paste, but also easily produce a short circuit risk when complex patterns with low line spacing is printed.

The liquid metal conductive paste in the embodiments of the present disclosure may further include an additive. The additive includes one or more of a dispersant, a wetting agent, a deformer, and a leveling agent.

In some embodiments of the present disclosure, the liquid metal conductive paste is formed by compounding a first component and a second component. The first component includes the liquid metal microcapsule. The second component includes the base polymer and the conductive powder. The first component further includes a first solvent, and/or, the second component further includes a second solvent. The aforementioned solvent is composed of the first solvent and/or the second solvent.

The compounding process of the first component and the second component can be completed immediately after the first component and the second component are separately prepared, the obtained liquid metal conductive paste can be stored or used. Alternatively, after the first component and the second component are separately prepared, the first component and the second component are stored separately. When the liquid metal conductive paste is in need, the first component and the second component are quantitatively weighed in a certain period of time (a few minutes to a few hours) in advance for compounding.

Figure 2:
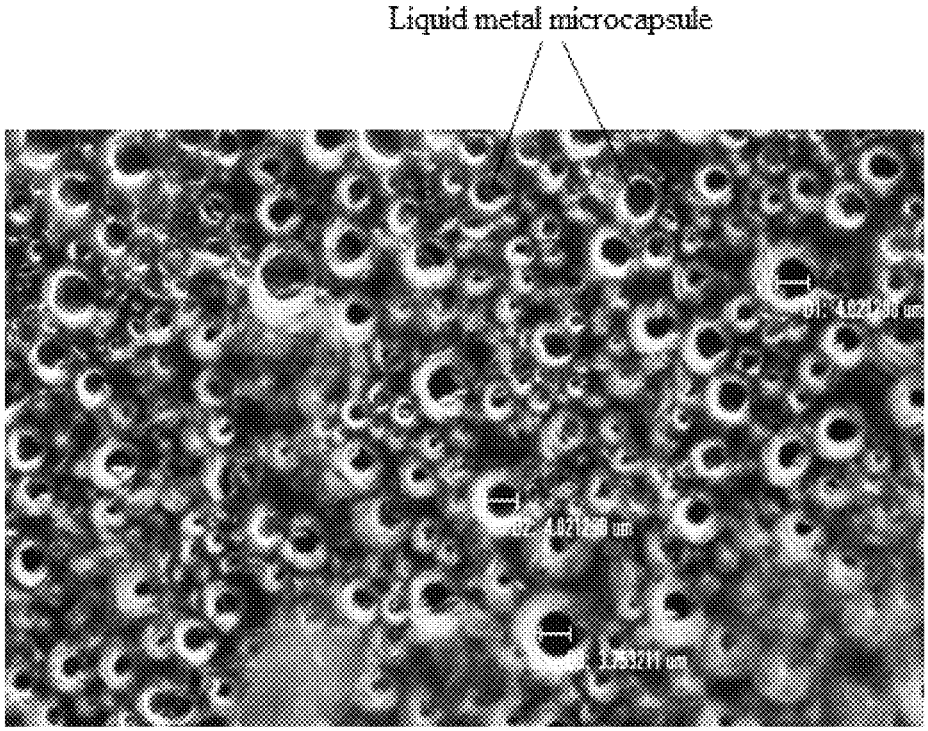
FIG. 2 is a partial enlarged view of FIG. 1 according to an embodiment of the present disclosure.
Figure 3:
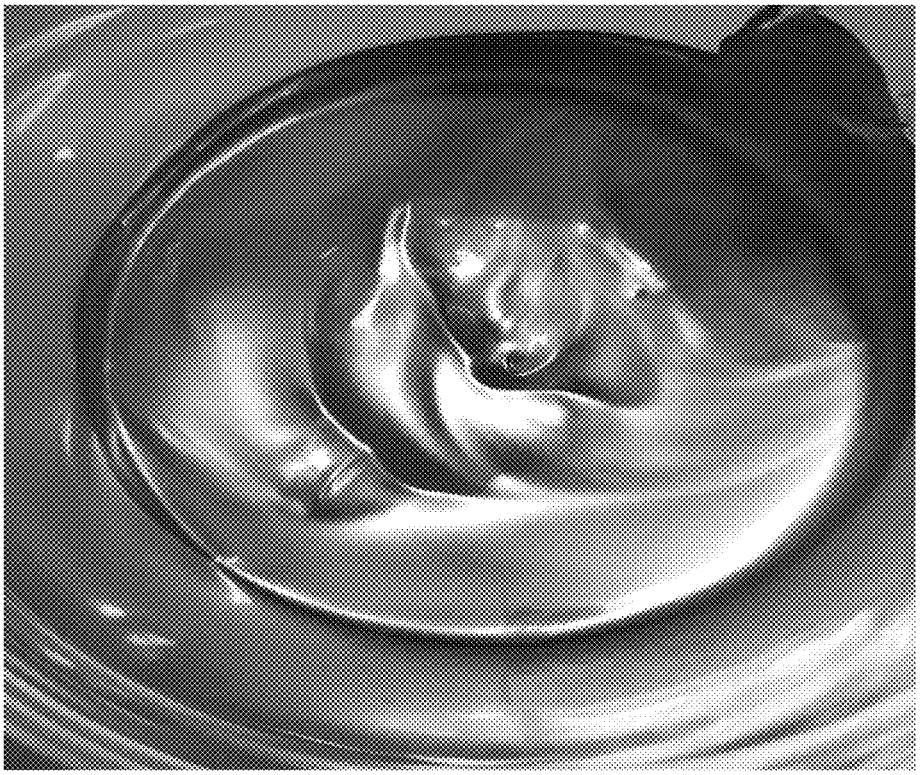
FIG. 3 is a real picture of a first liquid metal conductive paste according to an embodiment of the present disclosure.
Figure 4:
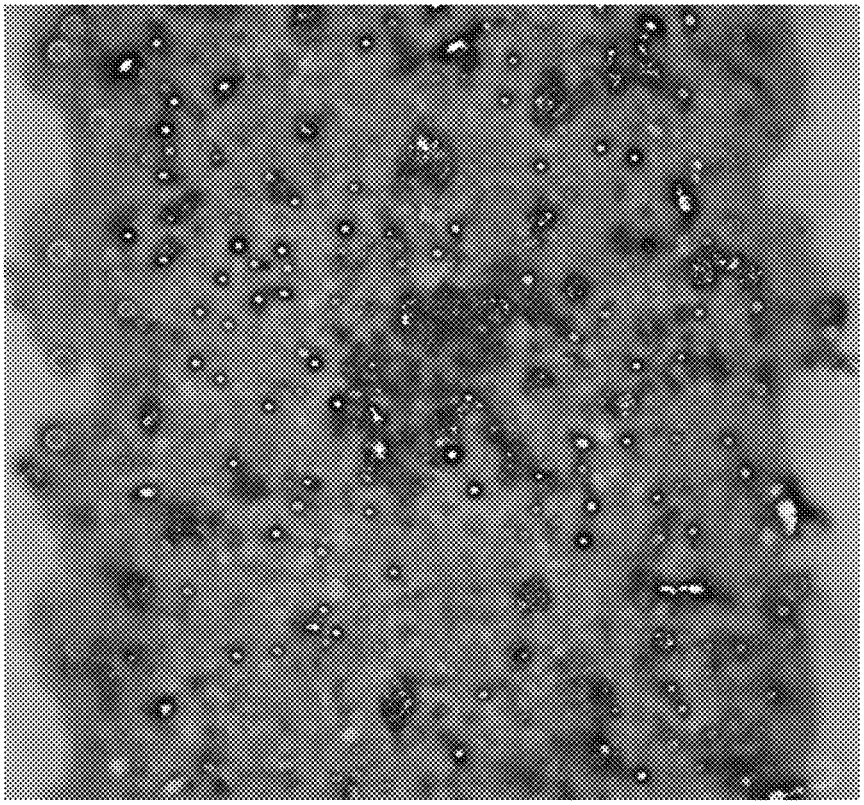
FIG. 4 is an optical micrograph of a contrast liquid metal conductive material according to an embodiment of the present disclosure.

As shown in FIG. 1, FIG. 2 and FIG. 3, FIG. 1 is an optical micrograph of a first liquid metal conductive paste according to an embodiment of the present disclosure, FIG. 2 is a partial enlarged view of FIG. 1 according to an embodiment of the present disclosure, and FIG. 3 is a real picture of a first liquid metal conductive paste according to an embodiment of the present disclosure, the liquid metal conductive paste manufactured by this method has high fineness, uniform distribution, and low resistance. As shown in FIG. 4, FIG. 4 is an optical micrograph of a contrast liquid metal conductive material according to an embodiment of the present disclosure. The liquid metal conductive paste manufactured not by the above method is prone to incurring agglomeration, flocculation, sedimentation and other phenomena of conductive powder, such that fineness is significantly decreased, and the conductive material has an uneven distribution, resulting in a significant increase in resistance. The specific reasons for the uniform dispersion of the liquid metal conductive paste in the embodiments of the present disclosure are as follows. The liquid metal is in the first component, and the conductive powder is in the second component. During the high energy process of manufacturing the first component and the second component, the liquid metal will not come into contact with the conductive powder. When it is required to use the liquid metal conductive paste, the mixing process does not need high energy upon mixing the first component and the second component, and the liquid metal is coated in the coating polymer, that is, the compounding process has no strong physical and chemical actions. Therefore, there is no negative interaction among the liquid metal, the conductive powder and resin to affect the overall performance of the liquid metal conductive paste.

For example, the above interactions include: the liquid metal is in direct contact with the conductive powder, and the liquid metal undergoes various "high-energy" processing processes (e.g., stirring, ball milling, sand milling, three-roll milling, etc.) to have a significant wetting and coating effect for the conductive powder. With the wetting and coating effect of the liquid metal, the conductive powders will collide with each other during the high-speed movement. to quickly fuse, and/or, the liquid metal changes the original spreading state of the wetting dispersant in the resin system in the solvent and resin, such that the resin is rapidly changed in morphology and is flocculated into units having extremely small surface area. Therefore, conductive powders cannot be provided with physical barrier and a stable double layer structure, which cause the conductive powders to agglomerate. The probability of this situation increases significantly with the increase of the filling amount of liquid metal and conductive powder. If the filling amounts of conductive powder and liquid metal are reduced, such a phenomenon can be avoided to a certain extent, but it causes a decrease in the content of effective components in the composite conductive paste and a decrease in the overall conductivity.

In the liquid metal conductive paste in the embodiments of the present disclosure, if the content of the first component is excessively high and the content of the second component is excessively low, it is not conducive to the electrical performance of the liquid metal conductive paste. If the content of the first component is excessively low and the content of the second component is excessively high, it is not conducive to the flexibility of the liquid metal conductive paste after being cured. Based on this, in some embodiments of the present disclosure, a weight ratio of the first component to the second component in the liquid metal conductive paste are selected to be in a range from 10:1 to 1:9, e.g., 10:1, 9:1, 8:1, 7:1, 6:1, 5:1, 4:1, 3:1, 2:1 3:2, 1:1, 2:3, 1:2, 2:5, 1:3, 1:4, 1:5, 1:6, 1:7, 1:8 or 1:9.

It should be noted that the coating polymer in the first component and the base polymer in the second component may be made of the same material or different materials. The first solvent in the first component may be the same with or different from the second solvent in the second component, which can be selected by those skilled in the art according to actual requirements.

The liquid metal conductive paste in the embodiments of the present disclosure may further include a viscosity modifier. After the first component and the second component are mixed, the viscosity of the liquid metal conductive paste can be adjusted by the viscosity modifier according to actual requirements. The above viscosity modifier can be one or more of ethyl acetate, petroleum ether, acetone, xylene, butyl carbitol, alcohol ester 12, and dibasic ester (DBE).

The details of the first component and the second component will be described in following embodiments of the present disclosure.

The First Component

If the content of the liquid metal in the first component is excessively little, the content of coating polymer in the first component is excessively large, and the thickness of the coating layer formed is excessively large, on the one hand, there are excessively many non-conductive materials such that the conductivity is decreased, on the other hand, the liquid metal is more difficult to destroy, which is not conducive to breaking to compensate for resistance variation in time when being bended. If the content of the liquid metal in the first component is excessively large, the content of coating polymer in the first component is excessively little, such that the thickness of the coating layer formed will be excessively little, it is difficult for the coating polymer to coat all the liquid metal, and it is not easy to achieve the stability of the liquid metal microcapsule.

Based on this, taking the first component including liquid metal microcapsules and the first solvent as an example, in some embodiments of the present disclosure, the first component can include 30% to 99% by weight of the liquid metal, 0.1% to 30% by weight of the coating polymer, and 0.9% to 50% by weight of the first solvent. For example, the weight content of liquid metal in the first component is 30%, 40%, 50%, 60%, 70%, 80%, 90%, 91%, 92%, 93%, 94%, 95%, 96%, 97%, 98% or 99%. The weight content of the coating polymer in the first component is 0.1%, 0.5%, 1.0%, 1.5%, 2.0%, 2.5%, 3.0%, 3.5%, 4.0%, 4.5%, 5.0%, 8%, 10%, 15%, 20%, 25% or 30%. The weight content of the first solvent in the first component is 0.9%, 1.0%, 2.0%, 3.0%, 4.0%, 5.0%, 6.0%, 7.0%, 8.0%, 10%, 15%, 20%, 30%, 40% or 50%.

Further, the applicant found that the ratio of the first solvent to the coating polymer determines the viscosity of the coating polymer solution formed by the first solvent and the coating polymer. When the adding amount of the first solvent is excessively low, the viscosity of the coating polymer solution is excessively large, the fluidity is poor, and it is difficult for the coating polymer to uniformly diffuse to the surface of liquid metal droplets. When the adding amount of the first solvent is excessively high, the initial viscosity of the coating polymer solution is relatively low, the stability of the structure formed by the coating polymer coating the liquid metal droplet is relatively poor, the coating polymer has poor blocking ability to adjacent liquid metal. During a standing or using process, the liquid metal droplet may be gathered and merged. Based on this, in some embodiments of the present disclosure, a mass ratio of the first solvent to the coating polymer can be selected to be in a range from 1:2 to 1:5, e.g., 1:3 or 1:4.

In some embodiments of the present disclosure, the melting point of the liquid metal in the first component is lower than or equal to room temperature, that is, the liquid metal is in a liquid state at room temperature, and the liquid metal can be gallium, gallium indium alloy, gallium tin alloy, gallium indium tin alloy, gallium indium tin zinc alloy, and the like.

In some embodiments of the present disclosure, the coating polymer in the first component includes one or more of polyester resin, melamine resin, chlorine vinegar resin, vinyl chloride-vinyl acetate resin, silicone resin, gelatin, sodium alginate, polyvinylpyrrolidone, chitosan, polyurethane resin, polyacrylic resin, vinyl chloride-vinyl acetate resin, epoxy resin, fluorocarbon resin, epoxy acrylic resin, epoxy acrylate resin, polyester acrylate resin, phenolic resin, nitrocellulose, ethyl cellulose, alkyd resin, amino resin, vinyl chloride-vinyl acetate copolymer resin, hydroxyl-modified vinyl chloride-vinyl acetate copolymer resin, thermoplastic polyurethane resin, or isocyanate having a blocking group and its oligomer. Selecting the above coating polymer has following advantages. On the one hand, the above coating polymer can exist stably with liquid metal for a long time, and the pH is close to neutral, it has no strong alkaline or acidic components, such that it may not have a significant chemical reaction with liquid metal. On the other hand, the above coating polymer has good compatibility with the base polymer of the second component, such that the liquid metal conductive paste has good fusion and no significant phase separation. On the other hand, the above coating polymer has self-film forming performance, which will not cause defects in the overall performance of the liquid metal conductive paste.

In some embodiments of the present disclosure, the first solvent in the first component is one or more of water, ethyl acetate, butyl acetate, isoamyl acetate, n-butyl glycolate, ethylene glycol butyl ether acetate, diethylene glycol butyl ether acetate, diglycol ethyl ether acetate, butyl acetate, petroleum ether, acetone, butyl ketone, cyclohexanone, methyl isobutyl ketone, diisobutyl ketone, isophorone, toluene, xylene, butyl carbitol, alcohol ester 12, DBE (dibasic ester), ethylene glycol butyl ether, glycol ethyl ether, dipropylene glycol methyl ether, dipropylene ethylene glycol butyl ether, propylene glycol phenyl ether, triglycol methyl ether, n-hexane, cyclohexane, n-heptane, n-octane, and isooctane.

In addition, according to actual requirements, one or more additive can be added to the first component, such as a deformer and a silicone additive. The silicone additive can simultaneously serve to defoam and increase flexibility. The silicone additive has a large molecular flexibility, such that it can fill the large-size gap formed when the more rigid coating polymer coats the liquid metal. Therefore, the coating rate of the liquid metal microcapsule is improved while providing a certain degree of flexibility, such that the rupture probability during the printing process is significantly reduced. In some embodiments of the present disclosure, the weight ratio of silicone additive to coating polymer is in a range from 1:5 to 1:10, e.g., 1:6, 1:7, 1:8 or 1:9, thereby avoiding affecting the mechanical performance of the liquid metal microcapsule and increasing the resistance caused by adding excessively much the silicone additive. If the silicone additive is excessively little, the optimal effects of the above two purposes can not be achieved.

Second Component:

If the conductive powder in the second component is excessively little and the base polymer is excessively much, the content of effective conductive material in the liquid metal conductive paste is reduced, and the conductivity is reduced. If the conductive powder in the second component is excessively much and the base polymer is excessively little, it is difficult to disperse the conductive powder uniformly, and phenomena such as agglomeration, flocculation, and sedimentation of the conductive powder may occur. Based on this, in the embodiments of the present disclosure, the weight content of the base polymer in the second component is in a range from 10% to 40%, the weight content of conductive powder is in a range from 20% to 90%.

For example, the weight content of the base polymer in the second component is 10%, 15%, 20%, 25%, 30%, 35% or 40%. The weight content of the conductive powder in the second component is 20%, 30%, 40%, 50%, 60%, 70%, 80% or 90%.

In some embodiments of the present disclosure, the base polymer in the second component is one or more of polyester resin, polyurethane resin, polyacrylic resin, vinyl chloride-vinyl acetate resin, epoxy resin, epoxy acrylic resin, epoxy acrylate resin, polyester acrylate resin, phenolic resin, nitrocellulose, ethyl cellulose, alkyd resin, amino resin, polyurethane resin with reactive groups, saturated polyester resin with reactive groups or flexible chlorine vinegar resin with reactive groups.

In some embodiments of the present disclosure, the conductive powder in the second component includes one or more of silver powder, copper powder, silver-coated copper powder, silver-copper powder, carbon black, graphite, graphene, carbon nanotubes, iron powder, and iron-nickel powder. When the conductive powder in the second component includes silver powder, the silver powder may be flake silver powder, spherical silver powder, rod-shaped silver powder, needle-shaped silver powder, or dendritic silver powder.

In some embodiments of the present disclosure, the second component may also include one or more of the second solvent and the additive, the weight content of the second solvent may be in a range from 0 to 10%, and the weight content of the additive may be in a range from 0 to 5%. For example, the weight content of the second solvent in the second component is 0%, 1.0%, 2.0%, 3.0%, 4.0%, 5.0%, 6.0%, 7.0%, 8.0%, 9% or 10%. The weight content of the additive in the second component is 0%, 1.0%, 2.0%, 3.0%, 4.0% or 5.0%.

In some embodiments of the present disclosure, the second solvent in the second component is one or more of water, ethyl acetate, butyl acetate, isoamyl acetate, n-butyl glycolate, ethylene glycol butyl ether acetate, diethylene glycol butyl ether acetate, diglycol ethyl ether acetate, butyl acetate, petroleum ether, acetone, methyl ethyl ketone, cyclohexanone, methyl isobutyl ketone, diisobutyl ketone, isophorone, toluene, xylene, butyl carbitol, alcohol ester 12, DBE, ethylene glycol butyl ether, glycol ethyl ether, dipropylene glycol methyl ether, dipropylene ethylene glycol butyl ether, propylene glycol phenyl ether, triethylene glycol methyl ether, n-hexane, cyclohexane, n-heptane, n-octane, and isooctane.

In some embodiments of the present disclosure, the additive in the second component includes one or more of a dispersant, a wetting agent, a deformer, a leveling agent, and the like. The dispersant may include one or more of anionic surfactants, nonionic surfactants and polymer surfactants.

Embodiment 2

In order to further improve the bending resistance performance of the wire made of the liquid metal conductive paste, a second aspect of the present disclosure further provides a liquid metal conductive paste as described below. The liquid metal conductive paste includes:

- a liquid metal microcapsule, the liquid metal microcapsule has a capsule wall of a coating polymer, and a capsule core of a liquid metal;
- a basic polymer;
- a conductive powder;
- a solvent;
- a crosslinking agent;
- in which, melting point of the liquid metal satisfies the condition that the liquid metal is in a liquid state at least when the wire made of the liquid metal conductive paste is deformed; and the crosslinking agent is configured to have a crosslinking reaction with the coating polymer and/or with the base polymer to form a three dimensional network structure during a curing process of a wire made of the liquid metal conductive paste.

Figure 5:
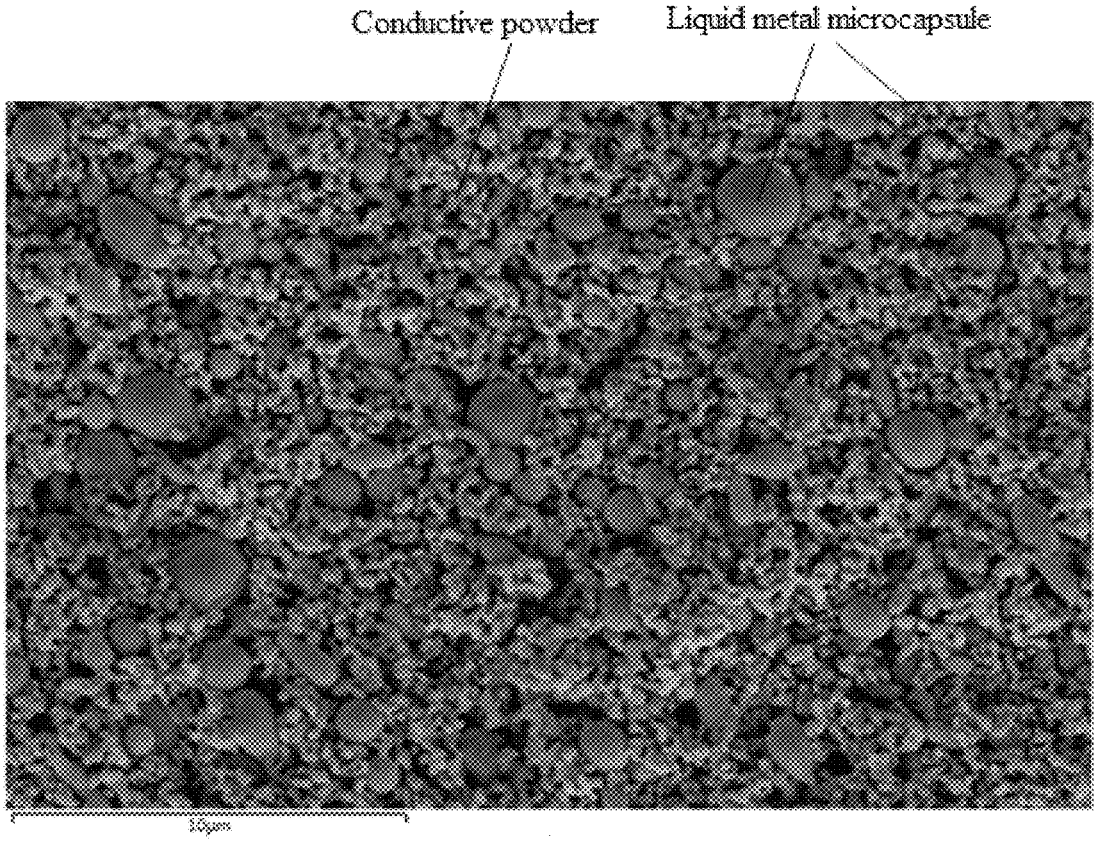
FIG. 5 is a scanning electron microscopic image of a second liquid metal conductive paste according to an embodiment of the present disclosure.

The reasons for the excellent bending resistance of the liquid metal conductive paste are mainly reflected in the following two aspects. On the one hand, the melting point of the liquid metal satisfies: the liquid metal is in a liquid state at least when the wire made of the liquid metal conductive paste is deformed. Therefore, when the wire undergoes deformation such as bending, stretching or twisting, the liquid metal microcapsule will deform and rupture, the coated liquid metal is released. The above liquid metal is in the liquid state and further has better fluidity and deformability, such that the liquid metal can fill and repair the conductive path. On the other hand, as shown in FIG. 5, FIG. 5 is a scanning electron microscopic image of a second liquid metal conductive paste according to an embodiment of the present disclosure, during the curing process of the wire made of metal conductive paste, the crosslinking agent reacts with the coating polymer and/or the base polymer to form a three dimensional network structure, which improves the intermolecular bonding force and compatibility of the conductive powder of the wire. When bending, stretching or twisting are performed, the local mechanical damage and stress concentration are less significant, such that peeling off the conductive powder is less significant, thereby achieving a more flexible wire. The wire made of the above liquid metal conductive paste can withstand more than 100,000 bending times and the resistance variation does not exceed 20%, and withstand more than 1 million bending times without breaking line.

In some embodiments of the present disclosure, the liquid metal conductive paste includes 1% to 50% by weight of the liquid metal microcapsule, 30% to 80% by weight of the conductive powder, 1% to 25% by weight of the base polymer, 10% to 40% by weight of the solvent, and 1% to 15% by weight of the crosslinking agent. For example, the weight content of the crosslinking agent in the liquid metal conductive paste may be 1%, 2%, 3%, 4%, 5%, 6%, 7%, 8%, 9%, 10%, 12% or 15%.

Further, the liquid metal conductive paste includes:

- a first component including a liquid metal microcapsule;
- a second component including a base polymer and a conductive powder;
- a crosslinking agent.

The first component further includes a first solvent, and/or, the second component further includes a second solvent.

The first component, the second component and the crosslinking agent are weighed in proportion, and mixed uniformly to obtain a liquid metal conductive paste.

The melting point of the liquid metal satisfies the condition that the liquid metal is in a liquid state at least when the wire made of the liquid metal conductive paste is deformed; and the crosslinking agent is configured to have a crosslinking reaction with the coating polymer of the first component and/or with the base polymer of the second component to form a three dimensional network structure during a curing process of a wire made of the liquid metal conductive paste.

The crosslinking agent is used to have a crosslinking reaction with the coating polymer of the first component and/or with the base polymer of the second component to form a three dimensional network structure, which have following situations. In case 1, the crosslinking agent is only used to have a crosslinking reaction with the coating polymer of the first component to form a three dimensional network structure. In case 2, the crosslinking agent is only used to have a crosslinking reaction with the base polymer of the second component to form a three dimensional network. In case 3, the crosslinking agent is used to have a crosslinking reaction with the coating polymer of the first component and the base polymer of the second component to form a three dimensional network structure. In addition, the crosslinking agent may be premixed in the first component and/or the second component, or added when the first component and the second component are mixed. The following Examples of the present disclosure provide the following examples for reference.

In a first example, the crosslinking agent is pre-mixed in the first component. The first component includes a coating polymer and a crosslinking agent. The crosslinking agent is used to have a crosslinking reaction with the coating polymer in the first component, and/or, with the base polymer in the second component to form a three dimensional network structure. At this time, in an embodiment, the coating polymer is a polymer, such as a resin.

In a second example, the crosslinking agent is premixed in the second component. That is, the second component includes a base polymer and a crosslinking agent. The crosslinking agent is used to have a crosslinking reaction with the coating polymer in the first component, and/or, with the base polymer in the second component to form a three dimensional network structure. At this time, in an embodiment, the base polymer is a polymer, such as a resin.

In a third example, the crosslinking agent is premixed in the first component and the second component at the same time. That is, the first component includes a coating polymer and a crosslinking agent, and the second component includes a base polymer and a crosslinking agent. The cross linking agent is used to have a crosslinking reaction with the coating polymer in the first component, and/or, with the base polymer in the second component to form a three dimensional network structure. At this time, in an embodiment, the coating polymer and the base polymer each are a polymer, such as a resin.

In a fourth example, the crosslinking agent is premixed in the first component, and a coating polymer in the first component is directly used as a crosslinking agent. It can also be understood that the coating polymer and the crosslinking agent are made of the same material, and the crosslinking agent is used to have a crosslinking reaction with the base polymer in the second component to form a three dimensional network structure. At this time, in an embodiment, the coating polymer is an oligomer, such as isocyanate and its oligomer.

In a fifth example, the crosslinking agent is premixed in the second component, and a base polymer in the second component is directly used as a crosslinking agent. It can also be understood that the base polymer and the crosslinking agent are made of the same material, and the crosslinking agent is used to have a crosslinking reaction with the coating polymer in the first component to form a three dimensional network structure. At this time, in an embodiment, the base polymer is an oligomer, such as isocyanate and its oligomer.

In the first example to the third example above, the material of the crosslinking agent is different from the materials of the coating polymer or the base polymer. In the fourth example to the fifth example above, the material of the crosslinking agent is the same with the materials of the coating polymer or the base polymer, that is, the coating polymer or the base polymer can be directly used as the crosslinking agent. If the coating polymer in the first component is directly used as the crosslinking agent, since the coating polymer is mostly oligomer and has good fluidity, the first solvent may be not existed in the first component. Similarly, if the base polymer in the second component is directly used as the crosslinking agent, since the base polymer is mostly oligomers and has good fluidity, the second solvent may be not existed in the second component.

It should be noted that when the crosslinking agent is premixed in a certain component (the first component or the second component) and is used to have a crosslinking reaction with the polymer (coating polymer or base polymer) in the component, the crosslinking agent should be a crosslinking agent with a blocking group, such as isocyanate with a blocking group and its oligomer. At this time, the crosslinking agent can have a crosslinking reaction with the polymer only during the high-temperature curing process of the wire manufactured by the liquid metal conductive paste. In addition, even if the crosslinking agent and the polymer with which the crosslinking reaction occurs are pre-mixed in the two components, respectively, after the first component and the second component are compounded to obtain the liquid metal conductive paste, if the obtained liquid metal conductive paste is used after a long time, a crosslinking agent with a blocking group should also be selected. In other cases, a crosslinking agent with a blocking group or a crosslinking agent without a blocking group can be used.

In some embodiments of the present disclosure, the weight ratio of the crosslinking agent to the polymer (base polymer and/or coating polymer) used for the crosslinking reaction therewith is between 1:10 and 1:1, e.g., 1:9, 1:8, 1:7, 1:6, 1:5, 1:4, 1:3, 2:5, 1:2, or 2:3.

When the crosslinking agent is used to have a crosslinking reaction with the base polymer in the second component, the base polymer can be a polyurethane resin with reactive groups, a saturated polyester resin with reactive groups, or a flexible chlorine vinegar resin with reactive groups. Further, the reactive group is a hydroxyl group, a carboxyl group or an amino group. It should be noted that when the reactive groups are different, a suitable crosslinking agent should be selected. For example, when the reactive group is a hydroxyl group or an amino group, the crosslinking agent can be selected as isocyanate and its oligomer, e.g., isocyanates with blocking groups and their oligomers, e.g., blocked isocyanates that are unblocked at 90° C. to 150° C.

In some embodiments of the present disclosure, the coating polymer is one of vinyl chloride-vinyl acetate copolymer resin, hydroxyl-modified vinyl chloride-vinyl acetate copolymer resin, thermoplastic polyurethane resin, or isocyanate with blocking groups and its oligomers. When the coating polymer is isocyanate and its oligomers with blocking groups, it can be used directly as the crosslinking agent. When the coating resin is a hydroxyl-modified vinyl chloride-vinyl acetate copolymer resin, it can have a crosslinking reaction with the crosslinking agent to form a three dimensional network structure.

Further, the average molecular weight, elongation at break, hardness, solid content and viscosity of the coating polymer solution can be comprehensively considered to achieve the best effect. For example, the coating polymer has an average molecular weight between 20,000 and 40,000. The reasons are as follows. The coating polymer with excessively low molecular weight has excessively high solid content when adjusted to a suitable viscosity, resulting in a decrease in conductivity. The coating polymer with excessively high molecular weight has a significant size shrink during curing, which is prone to causing the liquid metal to ooze. The coating polymer has an elongation at break of 150% to 250%. The coating polymer has a Shore hardness of A70 to A100 degrees. The coating polymer solution has a solid content between 20% and 40%. The coating polymer solution has a viscosity between 400 cp and 1200 cp.

In some embodiments of the present disclosure, the conductive powder in the second component is one of conductive silver powder, conductive copper powder, and silver-copper powder, and its structure is a flake structure, its length-to-thickness ratio is between 2 and 5, and its particle size is 1 to 5 μm, in order to further improve the bending resistance of the liquid metal conductive paste. In the presence of silver and copper, the powder having a length-to-thickness ratio greater than 5 and a particle size greater than 5 μm can aggravate the degree of electrochemical corrosion of the active components in the liquid metal. When the powder having a length-to-thickness ratio smaller than 2 and a particle size smaller than 1 μm achieves the desired conductivity, the filling amount is required to be excessively high, such that the increase in the ratio of powder to resin may significantly reduce the bending resistance and adhesion of the slurry. The Powder having excessively large particle size and excessively large length-to-thickness ratio may cause the proportion of the affected area to increase during the bending process, such that the amount of liquid metal that needs to balance the resistance variation is increased, thereby decreasing the resistance stability. Furthermore, the conductive powder has a bulk density of 1.4 to 2 g/cm$^3$, and a specific surface area of 0.4 to 0.7 m$^2$/g.

Embodiment 3

A third aspect of the present disclosure provides an electronic device. The electronic device includes a wire. The wire is made of any of the liquid metal conductive pastes described above. The electronic device can be any electronic devices that require wires, e.g., a flexible sensor, a wearable device, a flexible electronic tag, a FPC (flexible printed circuit) board, and especially an electronic device that require the flexible wire.

Figure 6:
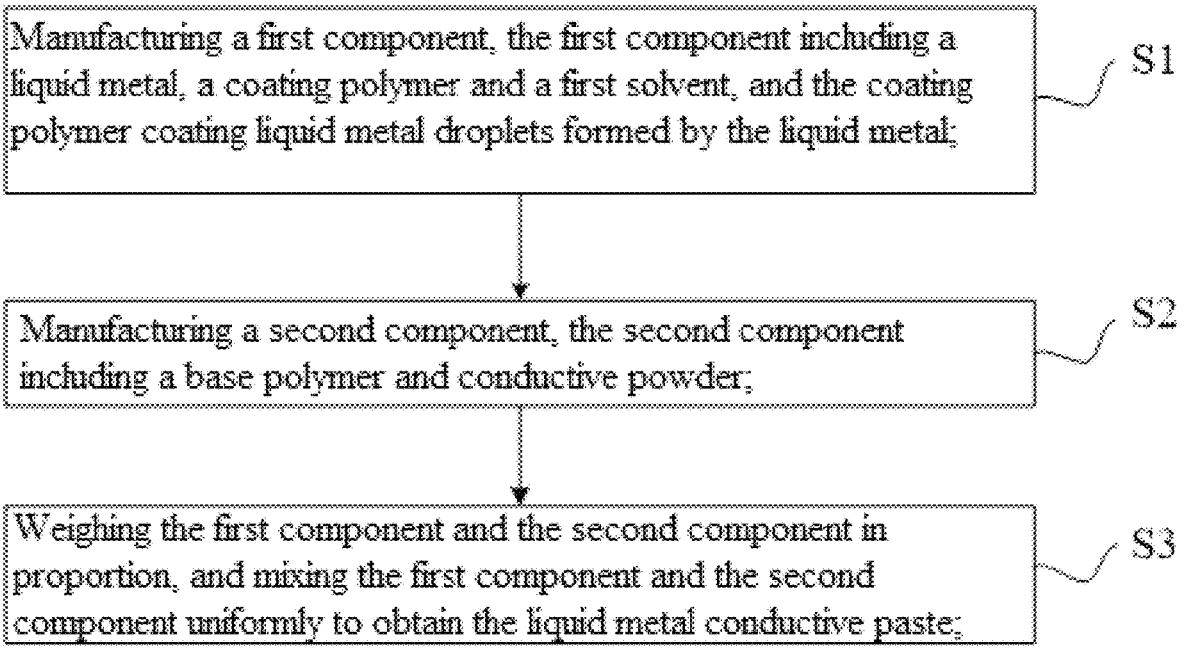
FIG. 6 is a flowchart of a method for manufacturing a conductive material according to an embodiment of the present disclosure.

A fourth aspect of the present disclosure provides a method for manufacturing a liquid metal conductive paste, which is used to manufacture the liquid metal conductive pastes described above. As shown in FIG. 6, FIG. 6 is a flowchart of a method for manufacturing a liquid metal conductive paste according to an embodiment of the present disclosure. In some embodiments of the present disclosure, the method for manufacturing the liquid metal conductive paste includes following steps.

In step S1, a first component is manufactured. The first component includes a liquid metal, a coating polymer and a first solvent. The coating polymer coats liquid metal droplets formed by the liquid metal.

In this step, the operating temperature should be higher than the melting point of the liquid metal.

In step S2, a second component is manufactured. The second component includes a base polymer and conductive powder.

In step S3, the first component and the second component are weighed in proportion, and the first component and the second component are mixed uniformly to obtain the liquid metal conductive paste.

In an embodiment of the present disclosure, the step S1 includes following sub-steps.

In sub-step S11, the coating polymer is dissolved by using the first solvent so as to form a coating polymer solution.

In sub-step S12, the coating polymer solution and the liquid metal are weighed in proportion, and the coating polymer solution and the liquid metal are put into a closed container.

In sub-step S13, a protective gas is filled to mix.

The operating temperature during the mixing process should be higher than the melting point of the liquid metal. The protective gas serves to prevent excessive oxidation of the liquid metal, avoid the decrease of the conductivity of the liquid metal and the increase of the viscosity.

In some embodiments of the present disclosure, the above mixing method may be mechanical stirring, ultrasound, or a combination thereof.

Sub-step S14: obtaining the first component after the mixing is completed.

After the mixing is completed, vacuum degassing can also be carried out to improve the performance of the prepared first component.

In another embodiment of the present disclosure, step S1 includes following sub-steps.

In sub-step S11', the coating polymer is dissolved by using the first solvent so as to form a coating polymer solution;

In sub-step S12', the coating polymer solution and the liquid metal are weighed in proportion, and the coating polymer solution and the liquid metal are added to the ball milling tank while adding grinding balls;

The operating temperature during the ball milling process should be higher than the melting point of the liquid metal.

In sub-step S13', ball milling is performed;

In sub-step S14', filtering is performed to discharge.

It should be noted that when the first component is premixed with a crosslinking agent, the crosslinking agent can be added between the sub-step S11 and the sub-step S13, or between the sub-step S11' and the sub-step S13'.

In some embodiments of the present disclosure, when the second component further includes a second solvent and an auxiliary agent, the step S2 includes following sub-steps.

In sub-step S21, the base polymer is dissolved into a resin solution by using the second solvent.

In sub-step S22, the resin solution and the auxiliary agent are weighed in proportion, and the auxiliary agent is added to the resin solution.

In sub-step S23, the conductive powder is weighed, and is put into a closed container together with the material obtained in sub-step S22.

In sub-step S24, the material obtained in step S23 is pre-dispersed by using a mixer.

In sub-step S25, the material obtained in step S24 is processed by using a three-axis rolling mill; the sub-step S25 can also be replaced by using a horizontal sand mill for sanding.

In sub-step S26, the material obtained in step S25 is defoamed to obtain the second component.

It should be noted that when the second component is pre-mixed with a crosslinking agent, the crosslinking agent can be added between the sub-step S21 and the sub-step S23.

In some embodiments of the present disclosure, step S3 includes following sub-steps.

In sub-step S31, the first component and the second component are weighed in proportion, and the first component and the second component are added to a container.

In sub-step S32, the first component and the second component are stirred uniformly.

In sub-step S33, a viscosity of the material obtained from sub-step S32 is measured to compare the viscosity with a preset viscosity range. If the viscosity is within the preset viscosity range, the material obtained from sub-step S33 is the liquid metal conductive paste. If the viscosity is higher than the preset viscosity range, sub-step S34 will be performed.

In sub-step S34, a viscosity modifier is added to adjust the viscosity of the material obtained from step S32 to be within the preset viscosity range, so as to obtain the liquid metal conductive paste.

The above preset viscosity range needs to be selected according to the corresponding process when the liquid metal conductive paste is used. For example, when a screen printing process is adopted, the above preset viscosity range can be 2000 cp to 6000 cp.

It should be noted that when the liquid metal conductive paste further includes a crosslinking agent, the crosslinking agent can be added to the container together with the first component and the second component in the above sub-step S31.

Embodiment 4

In order to let those skilled in the art understand and implement the flexible conductive paste provided by the embodiments of the present disclosure, some examples and comparative examples are provided as follows to describe performance advantages of the liquid metal conductive paste in the Embodiment 2.

| | | Example | | | | |
|---|---|---|---|---|---|---|
| | | 1 | 2 | 3 | 4 | 5 |
| Material composition | Liquid metal | GaInSn eutectic alloy, 8 g | GaInSn eutectic alloy, 8 g | GaInSn eutectic alloy, 16 g | GaInSn eutectic alloy, 16 g | GaInSn eutectic alloy, 24 g |
| | Coating polymer | Hydroxyl polyester resin, 0.5 g | Hydroxyl chlorine vinegar resin, 0.5 g | Thermoplastic polyurethane, 1 g | Hydroxyl chlorine vinegar resin, 1 g | Thermoplastic polyurethane, 1.5 g |
| | Solvent | Ethylene glycol butyl ether acetate, 2 g | Ethylene glycol butyl ether acetate, 2 g | Methyl ethyl ketone, 4 g | Ethylene glycol butyl ether acetate, 4 g | Methyl ethyl ketone, 6 g |
| | Crossing agent | Blocked isocyanate, 2.5 g | Blocked isocyanate, 2.5 g | Blocked isocyanate, 2.5 g | Blocked isocyanate, 2.5 g | Blocked isocyanate, 2.5 g |
| | Additive | Deformer, 0.1 g | Deformer, 0.1 g | Deformer, 0.1 g | Deformer, 0.1 g | Deformer, 0.1 g |
| | Conductive powder | Spherical conductive silver powder, 30 g | Flake conductive silver powder, 30 g | Flake conductive silver powder, 30 g | Flake conductive silver powder, 30 g | Flake conductive silver powder, 30 g |
| | Base polymer | Hydroxyl polyester resin, 2 g | Hydroxyl chlorine vinegar resin, 2 g | Hydroxyl polyester resin, 2 g | Hydroxyl chlorine vinegar resin, 2 g | Hydroxyl polyester resin, 2 g |
| | Solvent | Ethylene glycol butyl ether acetate, 8 g | Ethylene glycol butyl ether acetate, 8 g | Butyl acetate, 8 g | Ethylene glycol butyl ether acetate, 8 g | Butyl Acetate, 8 g |

In the liquid metal conductive pastes of the above Examples 1 to 5, it does not distinguish the first component and the second component, and is an integral composition.

| | | Example | | | | |
|---|---|---|---|---|---|---|
| | | 6 | 7 | 8 | 9 | 10 |
| First component | Liquid metal | GaInSn eutectic alloy, 8 g | GaInSn eutectic alloy, 16 g | GaInSn eutectic alloy, 16 g | GaInSn eutectic alloy, 16 g | GaInSn eutectic alloy, 24 g |
| | Coating polymer | Hydroxyl polyester resin, 0.5 g | Hydroxyl chlorine vinegar resin, 1 g | Thermoplastic polyurethane, 1 g | Isocyanate, 1 g | Isocyanate, 2 g |
| | First Solvent | Ethylene glycol butyl ether acetate, 2 g | Ethylene glycol butyl ether acetate, 4 g | Methyl ethyl ketone, 4 g | 0 | 0 |
| | Crossing agent | blocked isocyanate, 4 g | blocked isocyanate, 4 g | Isocyanate, 4 g | Isocyanate, 3 g | Isocyanate, 4 g |
| | Additive | Deformer, 0.1 g | Deformer, 0.1 g | Deformer, 0.1 g | Deformer, 0.1 g | Deformer, 0.1 g |
| Second component | Conductive powder | Spherical conductive silver powder, 30 g | Flake conductive silver powder, 30 g | Flake conductive silver powder, 30 g | Flake conductive silver powder, 30 g | Spherical conductive silver powder, 30 g |
| | Base polymer | Hydroxyl polyester resin, 2 g | Hydroxyl chlorine vinegar resin, 2 g | Hydroxyl polyester resin, 2 g | Hydroxyl chlorine vinegar resin, 2 g | Hydroxyl polyester resin, 2g |
| | Second Solvent | Ethylene glycol butyl ether acetate, 8 g | Ethylene glycol butyl ether acetate, 8 g | Butyl acetate, 8 g | Ethylene glycol butyl ether acetate, 8 g | Ethylene glycol butyl ether acetate, 8 g |
| | Crossing agent | 0 | 0 | 0 | 0 | 0 |

The liquid metal conductive pastes in the Examples 6 to 10 comprise the first component and the second component. The crosslinking agent was premixed in the first component. The isocyanate was used as the crosslinking agent. After the first component and the second component were compounded into a liquid metal conductive paste, the storage time of the liquid metal conductive paste should not be too long.

| | | Example | | | | | |
|---|---|---|---|---|---|---|---|
| | | 11 | 12 | 13 | 14 | 15 | 16 |
| First component | Liquid metal | GaInSn eutectic alloy, 8 g | GaInSn eutectic alloy, 8 g | GaInSn eutectic alloy, 16 g | GaInSn eutectic alloy, 8 g | GaInSn eutectic alloy, 8 g | GaInSn eutectic alloy, 8 g |
| | Coating polymer | Hydroxyl chlorine vinegar resin, 0.5 g | Thermoplastic polyurethane, 0.5 g | Hydroxyl chlorine vinegar resin, 1 g | Thermoplastic polyurethane, 0.5 g | Hydroxyl chlorine vinegar resin, 0.5 g | Hydroxyl chlorine vinegar resin, 0.5 g |
| | First Solvent | Ethylene glycol butyl ether acetate, 2 g | Isophorone, 2 g | Ethylene glycol butyl ether acetate, 4 g | Cyclohexanone, 2g | Ethylene glycol butyl ether acetate, 2 g | Diethylene glycol butyl ether acetate, 2 g |

-continued

| | | Example | | | | | |
|---|---|---|---|---|---|---|---|
| | | 11 | 12 | 13 | 14 | 15 | 16 |
| | Crossing agent | 0 | 0 | 0 | 0 | 0 | Blocked isocyanate, 0.5 g |
| | Additive | Deformer, 0.1 g | Deformer, 0.1 g | Deformer, 0.1 g | Deformer, 0.1 g | Deformer, 0.1 g | Deformer, 0.1 g |
| Second component | Conductive powder | Flake conductive silver powder, 30 g | Flake conductive silver powder, 30 g | Flake conductive silver powder, 30 g | Flake conductive silver powder, 40 g | Flake conductive silver powder, 20 g | Flake conductive silver powder, 15 g, Spherical conductive silver powder, 15 g |
| | Base polymer | Hydroxyl chlorine vinegar resin, 2 g | Hydroxyl chlorine vinegar resin, 2 g | Chlorine vinegar resin, 2g | Hydroxyl polyester resin, 2 g | Isocyanate, 2.5 g | Hydroxyl chlorine vinegar resin, 2 g |
| | Second solvent | Ethylene glycol butyl ether acetate, 8 g | Ethylene glycol butyl ether acetate, 8 g | Ethylene glycol butyl ether acetate, 8 g | Diglycol ethyl ether acetate, 8 g | 0 | Ethylene glycol butyl ether acetate, 8 g |
| | Crossing agent | Blocked isocyanate, 2.5 g | Blocked isocyanate, 2.5 g | Isocyanate, 2.5 g | Blocked isocyanate, 2.5 g | 0 | Blocked isocyanate, 2.0 g |

The liquid metal conductive pastes in the above Examples 11 to 15 comprise the first component and the second component. The crosslinking agent was premixed in the second component. The isocyanate was used as the crosslinking agent. After the first component and the second component were compounded into a liquid metal conductive paste, the liquid metal conductive paste should not be left for a long time. The liquid metal conductive paste in Example 16 was divided into a first component and a second component, and the crosslinking agent was premixed in the first component and the second component at the same time.

COMPARATIVE EXAMPLE

Comparative Example 1 is a commercially available flexible conductive silver paste which has a solid content of 70%, a silver content of 56%, and a solvent type of DBE.

The difference between Comparative example 2 and Example 6 is that the coating polymer and the first solvent were not added, but the liquid metal was directly added. Since the adding amount of liquid metal was small, the conductive paste could still be successfully manufactured.

The difference between Comparative example 3 and Example 7 is that the coating polymer and the first solvent were not added, but the liquid metal was directly added. Due to a large amount of filled liquid metal, flocculation directly occurred in Comparative example 3, and the conductive paste could not be successfully manufactured.

Performance Test

The conductive pastes of all the above Examples and Comparative examples were printed with a serpentine curve on a PI film with a thickness of 0.1 mm. The extension length of the serpentine curve was 30 cm and the width of the serpentine curve was 0.8 mm. The printing thickness of all samples is 15±2 μm. An automatic folding tester was used to fold the sample at a minimum bending radius of 0.1 mm from 0 to 180 degrees, and fold 1,000 times, 10,000 times, and 100,000 times respectively. The resistance variation rates before and after folding were compared.

| No. | Initial resistance (Ω) | Resistance after folding 1000 times (Ω) | Resistance variation rate after folding 10000 times (%) | Resistance after folding 10000 times (Ω) | Resistance variation rate after folding 10000 times (%) | Resistance after folding 10000 times (Ω) | Resistance variation rate after folding 10000 times (%) |
|---|---|---|---|---|---|---|---|
| Example 1 | 3.2 | 3.5 | 9.37% | 3.7 | 15.63% | 4.4 | 37.50% |
| Example 2 | 2.9 | 3.3 | 13.79% | 3.8 | 31.03% | 4.2 | 44.83% |
| Example 3 | 3.9 | 4.1 | 5.13% | 4.4 | 12.82% | 5.5 | 41.03% |
| Example 4 | 3.8 | 4.2 | 10.53% | 4.5 | 18.42% | 5.3 | 39.47% |
| Example 5 | 4.9 | 5 | 2.04% | 5.8 | 18.37% | 6.2 | 26.53% |
| Example 6 | 3.7 | 4 | 8.11% | 4.6 | 24.32% | 5.4 | 45.95% |
| Example 7 | 4.1 | 4.2 | 2.44% | 4.8 | 17.07% | 5.8 | 41.46% |
| Example 8 | 4.2 | 4.3 | 2.38% | 4.9 | 16.67% | 5.3 | 26.19% |
| Example 9 | 4.4 | 4.8 | 9.09% | 5.4 | 22.73% | 6.6 | 50.00% |
| Example 10 | 5.2 | 5.6 | 7.69% | 6.2 | 19.23% | 6.5 | 25.00% |
| Example 11 | 3.3 | 3.5 | 6.06% | 3.7 | 12.12% | 4.3 | 30.30% |
| Example 12 | 3.5 | 3.6 | 2.86% | 3.8 | 8.57% | 4.9 | 40.00% |
| Example 13 | 4 | 4 | 0.00% | 4.2 | 5.00% | 4.8 | 20.00% |
| Example 14 | 2.2 | 2.6 | 18.18% | 3.2 | 45.45% | 4.4 | 100.00% |
| Example 15 | 6.8 | 7.1 | 4.41% | 7.5 | 10.29% | 8.5 | 25.00% |
| Example 16 | 3.3 | 3.4 | 3.03% | 3.7 | 12.12% | 4.1 | 24.24% |

-continued

| No. | Initial resistance (Ω) | Resistance after folding 1000 times (Ω) | Resistance variation rate after folding 10000 times (%) | Resistance after folding 10000 times (Ω) | Resistance variation rate after folding 10000 times (%) | Resistance after folding 10000 times (Ω) | Resistance variation rate after folding 10000 times (%) |
|---|---|---|---|---|---|---|---|
| Comparative Example1 | 3.9 | 7.9 | 102.56% | NA | NA | NA | NA |
| Comparative Example2 | 3.8 | 4 | 5.26% | 8.7 | 128.95% | 18.4 | 384.21% |
| Comparative Example3 | — | — | — | — | — | — | — |

Finally, it should be noted that the technical solutions of the present disclosure are illustrated by the above embodiments, but not intended to limit thereto. Although the present disclosure has been described in detail with reference to the foregoing embodiments, those skilled in the art can understand that the present disclosure is not limited to the specific embodiments described herein, and can make various obvious modifications, readjustments, and substitutions without departing from the scope of the present disclosure.

What is claimed is:

1. A liquid metal conductive paste, comprising:

1% to 50% by weight of a liquid metal microcapsule;

30% to 80% by weight of a conductive powder;

1% to 25% by weight of a base polymer; and

10% to 40% by weight of a solvent, wherein the liquid metal microcapsule has a capsule wall of a coating polymer, and a capsule core of a liquid metal; and melting point of the liquid metal satisfies a condition that the liquid metal is in a liquid state at least when a wire made of the liquid metal conductive paste is deformed.

2. The liquid metal conductive paste according to claim 1, wherein the liquid metal conductive paste is formed by compounding a first component and a second component; the first component comprises the liquid metal microcapsule; the second component comprises the base polymer and the conductive powder; the first component further comprises a first solvent, and/or, the second component further comprises a second solvent.

3. The liquid metal conductive paste according to claim 2, wherein the first component further comprises a silicone additive for defoaming and increasing flexibility.

4. The liquid metal conductive paste according to claim 3, wherein a weight ratio of the silicone additive to the coating polymer is in a range from 1:5 to 1:10.

5. The liquid metal conductive paste according to claim 2, wherein a weight ratio of the first component to the second component in the liquid metal conductive paste is in a range from 10:1 to 1:9.

6. The liquid metal conductive paste according to claim 2, wherein the first component comprises 30% to 99% by weight of the liquid metal, 0.1% to 30% by weight of the coating polymer, and 0.9% to 50% by weight of the first solvent.

7. The liquid metal conductive paste according to claim 2, wherein the weight content of the base polymer in the second component is in a range from 10% to 40%, and the weight content of the conductive powder in the second component is in a range from 20% to 90%.

8. The liquid metal conductive paste according to claim 1, wherein the liquid metal microcapsule has a diameter ranging from 3 μm to 10 μm.

9. The liquid metal conductive paste according to claim 1, wherein the liquid metal comprises at least one of gallium, gallium indium alloy, gallium tin alloy, gallium indium tin alloy, or gallium indium tin zinc alloy.

10. The liquid metal conductive paste according to claim 1, wherein the coating polymer comprises at least one of polyester resin, melamine resin, chlorine vinegar resin, vinyl chloride-vinyl acetate resin, silicone resin, gelatin, sodium alginate, polyvinylpyrrolidone, chitosan, polyurethane resin, polyacrylic resin, epoxy resin, fluorocarbon resin, epoxy acrylic resin, epoxy acrylate resin, polyester acrylate resin, phenolic resin, nitrocellulose, ethyl cellulose, alkyd resin, amino resin, hydroxyl-modified vinyl chloride-vinyl acetate copolymer resin, thermoplastic polyurethane resin, or isocyanate having a blocking group and its oligomer.

11. The liquid metal conductive paste according to claim 1, wherein the base polymer comprises at least one of polyester resin, polyurethane resin, polyacrylic resin, vinyl chloride-vinyl acetate resin, epoxy resin, epoxy acrylic resin, epoxy acrylate resin, polyester acrylate resin, phenolic resin, nitrocellulose, ethyl cellulose, alkyd resin, amino resin, polyurethane resin with a reactive group, saturated polyester resin with a reactive group, or flexible chlorine vinegar resin with a reactive group.

12. An electronic device, comprising a wire, wherein the wire is made of the liquid metal conductive paste according to claim 1.

13. A liquid metal conductive paste, comprising:

1% to 50% by weight of a liquid metal microcapsule;

30% to 80% by weight of a conductive powder;

1% to 25% by weight of a base polymer;

10% to 40% by weight of a solvent; and

1% to 15% by weight of a crosslinking agent, wherein the liquid metal microcapsule has a capsule wall of a coating polymer, and a capsule core of a liquid metal; and melting point of the liquid metal satisfies the condition that the liquid metal is in a liquid state at least when a wire made of the liquid metal conductive paste is deformed; and the crosslinking agent is configured to have a crosslinking reaction with the coating polymer and/or the base polymer to form a three dimensional network structure during a curing process of the wire made of the liquid metal conductive paste.

14. The liquid metal conductive paste according to claim 13, wherein the liquid metal conductive paste is formed by compounding a first component and a second component; the first component comprises the liquid metal microcapsule; the second component comprises the base polymer and the conductive powder; the first component further comprises a first solvent, and/or, the second component further comprises a second solvent; and the crosslinking agent is premixed in the first component, and/or, the crosslinking agent is premixed in the second component.

15. The liquid metal conductive paste according to claim 14, wherein the base polymer and/or the coating polymer contain a reactive group which is hydroxyl, amino, or carboxyl.

16. The liquid metal conductive paste according to claim 15, wherein the reactive group is hydroxyl or amino; and the crosslinking agent is isocyanate and an oligomer thereof.

17. The liquid metal conductive paste according to claim 16, wherein the crosslinking agent is isocyanate and its oligomer having a blocking group.

18. The liquid metal conductive paste according to claim 13, wherein the coating polymer comprises at least one of vinyl chloride-vinyl acetate copolymer resin, hydroxyl-modified vinyl chloride-vinyl acetate copolymer resin, thermoplastic polyurethane resin, or isocyanate having a blocking group and its oligomer.

19. The liquid metal conductive paste according to claim 18, wherein the coating polymer has an average molecular weight ranging from 20,000 to 40,000.

20. The liquid metal conductive paste according to claim 13, wherein the conductive powder comprises at least one of conductive silver powder, conductive copper powder, or silver copper powder, and the conductive powder has a flake structure with a length-to-thickness ratio ranging from 2 to 5, and a particle size of 1 μm to 5 μm.

* * * * *